US007300549B2

(12) United States Patent
Pietikäinen

(10) Patent No.: US 7,300,549 B2
(45) Date of Patent: Nov. 27, 2007

(54) METHOD FOR CONTROLLING THE OPERATION OF A PAPER, BOARD OR TISSUE PRODUCTION LINE

(75) Inventor: Reijo Pietikäinen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 40 days.

(21) Appl. No.: 10/467,426

(22) PCT Filed: Feb. 8, 2002

(86) PCT No.: PCT/FI02/00094

§ 371 (c)(1),
(2), (4) Date: Nov. 26, 2003

(87) PCT Pub. No.: WO02/064886

PCT Pub. Date: Aug. 22, 2002

(65) Prior Publication Data

US 2004/0065426 A1 Apr. 8, 2004

(30) Foreign Application Priority Data

Feb. 9, 2001 (FI) ..... 20010250

(51) Int. Cl.
*D21F 1/32* (2006.01)

(52) U.S. Cl. ..... 162/199; 162/198; 162/DIG. 10; 100/162 B; 100/155 R

(58) Field of Classification Search ..... 162/199, 162/198, DIG. 10; 100/162 B, 155 R
See application file for complete search history.

(56) References Cited

U.S. PATENT DOCUMENTS 5,961,899 A * 10/1999 Rossetti et al. ..... 264/40.1
6,257,133 B1 * 7/2001 Anderson ..... 100/162 B

FOREIGN PATENT DOCUMENTS

| | | | |
|---|---|---|---|
| FI | 79571 | * | 9/1989 |
| FI | 105115 B | | 6/2000 |
| WO | WO 02/064886 A2 | | 8/2002 |

OTHER PUBLICATIONS

"Properties and Applications of Commercial Magnetorheological Fluids", by Mark R. Jolly, Jonathon W. Bender and J. David Carlson, SPIE 5th Annual Int. Symposium on Smart Structures and Materials, San Diego, CA, Mar. 15, 1998.

(Continued)

*Primary Examiner*—Mark Halpern
(74) *Attorney, Agent, or Firm*—Stiennon & Stiennon

(57) ABSTRACT

The invention relates to a method for controlling the operation of a paper, board or tissue production line (11, 12, 13, 14, 17, 18). A magneto-rheological or an electrolrheological fluid, whose flow characteristics are changed in a controlled way, is used in the method. The fluid is used as a lubricant between surfaces in a device consisting of a fixed surface and a surface that is moved over it as a heating medium, as the dampening or the power transmission agent of the movement of paper and/or board equipment (17, 18), or as a hydraulic fluid of the emergency opening cylinders of a set of calender rolls (1) of a paper and/or board machine.

12 Claims, 3 Drawing Sheets

OTHER PUBLICATIONS

"Electro- and Magnetorheological Fluids. Part 1. ; Fundamentals", Kimmo K. Mäkelä, Tribologia Finnish Journal of Tribology, vol. 15/1996.

International Preliminary Examination Report issued in PCT/FI02/00094, Oct. 2002.

International Search Report issued in PCT/FI02/00094, Aug. 2002.

* cited by examiner

METHOD FOR CONTROLLING THE OPERATION OF A PAPER, BOARD OR TISSUE PRODUCTION LINE

CROSS REFERENCES TO RELATED APPLICATIONS

This application is a national stage application of International Application No. PCT/FI02/00094, filed Feb. 8, 2002, and claims priority on Finish Application No. 20010250, filed Feb. 9, 2001, the disclosures of both applications being hereby incoporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to controlling the operation of a paper, board or tissue production line at various stages by means of fluids used, such as lubricating, heat transfer or hydraulic fluids, in the equipment. The invention can especially be used in paper and/or board machines and in the finishing units thereof.

In paper and/or cardboard manufacture, for example, so-called long nip or shoe nip solutions can be used at the various stages. They comprise a rotating belt and a roll that presses against it so that the belt travels a fairly long way on the surface of the roll. The belt is supported in the nip by means of a shaped surface, so-called shoe. A thin film of oil can be spread between the shoe and the belt, often through a special oil pocket. The oil film allows the belt to slide on the shoe as frictionlessly as possible. Through the film, by setting the shoe and the flow state, forces that support the belt in the normal direction can be controlled. These forces are supporting forces that receive the nip pressure, and they can be used to adjust the pressure distribution of the nip both in the machine direction (MD, the length of the nip) and in the cross machine direction (CD, profiling). The long nip can be used in calenders in particular, and also in pressure apparatuses.

In traditional long nip solutions, the action of the nip can be influenced by selecting a desired oil and by adjusting the volume of the supply flow. The properties of the oil are relatively constant, excluding the change in viscosity caused by a possible change in the temperature. The volume of the supply flow can also be controlled in the cross machine direction, if the shoes and/or the outlet flow are divided into corresponding functional blocks.

In many devices used in paper and/or board manufacture, for example, include heat transfer by means of a fluid is included. For example, heated rolls, such as the thermo rolls of calenders, polymer rolls of calenders provided with balancing or cooling solutions, and, generally, heat exchangers. Water, steam or oil is generally used as the heating medium.

The effectiveness and the action of heat transfer, in general largely depend on the properties of the medium used and on the character of the flow. Firstly, the transfer of great heat powers requires a large flow velocity. Furthermore, the boundary-layer flow of the medium and of the surface that delivers or receives heat should be relatively abrupt, so that heat would transfer effectively enough over the boundary layer. Sufficient flow velocities can be provided using small flow channels, in which the wall surface of the channel is also relatively large compared with the cross-sectional area of the flow channel.

In traditional heat transfer solutions, the flow of the medium can only be influenced to a limited extent. For flow control, the only means available have been the design of the flow channels and different displacement and choking block solutions. These means have been used to try to keep the flow velocity of the medium optimal in each situation, for instance to equalize the heat transfer of a thermo roll in the cross machine direction. Solutions that increase the turbulence of the channel flow are also known. These include, for example, a spiral or the like placed in the channel, or roughening of the channel walls.

Paper webs can be pressed using a heated roll both in pressure apparatuses and calenders. The purpose in the pressure apparatus is to heat the web so that the viscosity of water decreases and thus the exit of water from the web is easier. In impulse drying, the idea is to heat the web so that the water evaporates and the increased pressure drives the water out of the web. The calender is used to heat the line so that the fibres become soft, whereby they are easier to work up.

Both in the pressure apparatus and the calender profiling tubular variable crown rolls are used. The roll is loaded from the inside by using shoe elements. These rolls can be used, for example, as coated backing rolls or heated thermo rolls.

Both in the pressure apparatus and the calender generally, a way to heat the roll, which is based on the flow of the heating medium, is used. The jacket of the roll has axial channels, through which the heating medium is conducted. To balance temperature differences, the medium in some channels goes in the opposite direction than in the others. To balance the temperature differences, a so-called displacement block solution has also been used, in which blocks placed in certain locations in the flow channel are used to decrease the cross-sectional area of the flow, whereby the flow velocity is increased. In that case, also the heat transfer is enhanced. Centre drilling can also be used as a flow channel in the rolls. A heating medium that flows in the channels is also used to cool unheated polymer rolls and to equalize the temperature differences. The heating medium is directed to the channels in the roll jacket through the ends of the roll by using the channels in the end pieces. One problem in the heat transfer is the changes in shape caused by irregular temperature distribution.

Many devices used in paper and/or cardboard manufacture contain regulating units of mechanical movement, such as dampers, switches or brakes. To control linear movements, for example, dampers are used to stop the movement of masses or to dampen oscillation or vibration. In rotary transmission lines, switches and brakes are used to move the torque. These regulating units are often hydraulic.

SUMMARY OF THE INVENTION

The invention is based on using magneto-rheological (MR) or electro-rheological (ER) fluids (MR/ER fluids). These fluids are characterized in that their properties, viscosity in particular, can be influenced by means of a magnetic (M) or an electric (E) field. This is based on the fact that these fluids contain particles, which are arrayed (chained) under the influence of M or E fields. In this way, the flow properties can also be influenced by other means than changing the temperature. The change in viscosity can also be very significant, for example as much as one decade for the MR fluids. According to the invention, the adaptive flow properties of the MR/ER fluids can be utilized.

The operational principle of MR/ER fluids has been known since as early as the 1940s. It is well known to use MR/ER fluids in numerous applications, mainly in dampers and switches related to rotary and linear movements. Examples include the springing of cars and construction machines, seismic dampers or the adjustable friction brakes of exercise bicycles. Further examples include accurately adjustable optic grinders and pumping applications.

MR/ER fluids are described, for example, in the publication Mäkelä, Finnish Journal of Tribology, vol. 15, No 1, 1996. In particular, MR fluids have been suggested for mediums, for example, in brakes and switches, and semi-active springing of vehicles. For example, the publication Jolly et al., SPIE 5$^{th}$ Annual Symposium on Smart Structures and Materials, 1998, describes some applications. ER fluids have been utilized in adjustment solutions for valves, among others. Publication FI 79571, for example, discloses a variable pressing element of a paper web, in which the web's profile in the cross machine direction is adjusted by a set of hydraulic elements, in which the pressures of the pressure medium are adjusted by pressure reducing valves based on the electro-rheological (ER) effect.

Generally, the MR/ER fluids consist of a basic phase (such as a mineral oil or the like) and micro particles, which are polar or polarized in a field and which react to magnetic or electric fields. Generally, the particles consist of a fine ferromagnetic substance (iron or the like). In a magnetic field, the MR particles orientate with the field, are formed into a grid, and thus have a strong effect on the viscosity of the mixture.

Correspondingly, the particles in the ER fluids react to an electric field. In practice, the change in viscosity can be very considerable. The state of the mixture can vary between a very fluent and a glassy, nearly solid state.

An electric field is directed at the ER fluid in a desired area. The field is usually implemented by means of two electrodes that are charged by opposite signs. The electrodes can be placed, for example, on opposite walls of a flow channel. The magnetic field is generated using suitably located magnetic poles or coils (electromagnets). In principle, the magnets can also be located outside the flow channel, unless the wall of the channel disturbs the magnetic field too much. In most practical solutions, it is most likely easier to arrange the magnetic field, for example, by using suitable permanent magnets or electromagnets than to generate the electric field needed.

MR fluids provide a greater change in viscosity than ER fluids. Generally, the MR fluids also have a better heat resistance, as it generally is only limited by the carrier phase.

In the applications according to the invention, the preferable properties of the MR/ER fluids include a quick response and accuracy of control. A change in viscosity is proportional to a change in the field, which in turn can be made directly dependent on the control voltage. The viscosity can be made to change very quickly, even in a few milliseconds. The viscosity can also be made to change very locally; for example, for MR fluids within the coverage area of the magnetic control field, at an accuracy of about one millimetre. In practice, to generate a sufficient field, a fairly low control power can be sufficient. For example, to generate a sufficient magnetic field, normally, a current of about 1-2 A can be used in a system of 12-24 V. Thus, the properties of the substance can be controlled quickly and accurately exactly in the desired location.

The required field can be produced actively or passively. The magnetic field can be produced actively using an electromagnet, for example, whereby it can be controlled by means of a control voltage, or passively by means of a permanent magnet, for example, whereby the field of influence is static and cannot be adjusted.

It is also possible that the passive magnetic field (the permanent magnet) is eliminated by another magnet, the polarity of which is set at "opposite signs". In that case, the "static" effect of the permanent magnet can be eliminated by another (active) measure.

The viscosity of the MR/ER fluid can be selected to be so low that the operation of the process is satisfactory even without the M/E field. By means of the M/E field, the viscosity is then increased to an optimal level for the process. In this way, as a possible elimination of the M/E field does not stop the process, passive safety is achieved.

The first object of the invention is a device consisting of a fixed surface (shoe) and a surface that is moved over it, wherein fluid is fed between the surfaces to act as a lubricating or a hydraulic medium. In controlling the regulating units of the fluid supply or the operation of the fluid, the controllability of the viscosity of the flowing fluid can be used. The surface to be conveyed can be a belt, such as a metal belt. An object of application can be a so-called long nip, in particular, wherein the belt is pressed against the fixed surface by means of a roll or another belt. In particular, the long nip can be the long nip of a paper and/or board machine and its finishing equipment, such as a calender nip or a press nip. The surface to be conveyed can also be the jacket of the roll, which is supported by means of the shoes.

When MR/ER fluid, oil in particular, is used between the shoe and the movable surface, and its properties are changed as necessary by using magnetic or electric fields, the properties of this fluid, viscosity in particular, can be influenced in a controlled way, and the hydrodynamic-mechanical operation of the device can thus be controlled. The oil that is pumped between the shoe and the belt creates a lubricating layer, which transmits the pressure force that supports the belt through hydraulic pressure.

In a pressure zone implemented by the MR/ER fluid, the viscosity can be gradually altered in the cross direction of the flow gap, so that no clear and sharp edge of the flow area can be defined. In the nip, this provides the advantage that the nip is more flexible for sudden variations in the thickness of the web, which occur in the nip (for example, fault situations, such as a foreign object in the nip, e.g., an extra layer of paper). When the pressure in the nip increases, even the area of a higher viscosity yields.

The regulating members of the field (e.g., electromagnets) can be located in the shoe so that their effect extends to the liquid coating, liquid pocket or inflow tube system. The regulating members can be distributed in the cross machine direction so that profiling is possible.

MR fluid is preferably used. It is best influenced by means of electromagnets.

A decrease in the viscosity of the liquid coating and a possible flow pocket decreases the thickness (minimum gap) and the rolling resistance (power consumption) of the coating. A decrease of about 50% in the viscosity decreases the thickness of the liquid coating and the rolling resistance by about 30%. In the area of the tube system and the pocket, manipulation of viscosity affects the supply flow velocity in the first place and, through that, the hydrodynamic operation of the shoe. In this way, both the influence of the nip on the web can be controlled and the wear of the equipment and the energy consumption can be optimised in various ways.

When the flow situation of the shoe can be controlled as accurately as possible, the same shoe construction can be used in various process situations (such as control of the nip length). A change in viscosity caused by a change in the temperature of the liquid can also be compensated using the MR/ER effect.

A special advantage is provided by the possibility to profile the pressure distribution in the cross direction.

Both in a pressure apparatus and a calender, the size and the coverage area of the pressing support force with respect to the process can be optimally dimensioned. A wet press can be used to control the nip pressure distribution accurately. The pressure can be allowed to increase towards the trailing edge of the nip so that water exits the web quickly enough; however, without breaking the structure of the web. In a calender, the nip delay and the pressure can be dimensioned in accordance with the process situation, often so that a longer nip is used for thicker cardboard qualities.

It is especially advantageous for both the pressure apparatus and the calender to both control the length of the pressure area in the machine direction and the pressure distribution in the cross direction (profiling). When the pressure area can be accurately defined also in the cross direction, the contact between the belt and the roll outside the web can be avoided.

The length, the width, and the nip pressure of the shoe nip pressing area can advantageously be controlled by using a MR fluid and suitably located permanent or electromagnets. For example, the electromagnets can be suitably located in connection with the shaped shoe on the flow surface above it at various distances in the machine direction. In that case, by activating the magnets at different distances, the fluid that flows in the pocket and the lubricating layer can be congealed in desired places. In this way, the flow gap between the belt and the shoe (or the congealed fluid) and the forming hydrostatic pressure can be influenced in particular. Accordingly, the hydraulic length of the shoe can be changed, for example.

When several magnets are located in the cross direction at sections or to be controlled in the cross direction in some other way, the solution can be used for profiling. The strength of the magnetic field can be changed and the desired magnets can be activated in a desired position in the cross direction, so that the size of the nip area and/or the extent of the pressure area (the length of the nip) are locally controlled. Control of the edge of the pressure area (at the edge of the track area) is a special case here.

The flow, the flow of the inlet pipe in particular, can as if be controlled by using a valve that has no moving parts. The system is also safe in the sense that if the control voltage is disconnected (i.e., "the valve" is opened), the regulating unit turns passive and the equipment operates like conventional equipment. For example, the nip can also be profiled in accordance with the invention. Control, such as the control of the pressure distribution and the nip length, is also locally quick and accurate. No moving parts are needed in the adjustment.

When the flow can be locally manipulated, the shape of the shoe can be simplified, if so desired. In the extreme, the shoe could be a plane or a rotary segment, the flow technological "shape" of which is produced by focusing a magnetic or electric field of a different size at a different point. A thicker fluid coating is formed in the area of a strong field, as the fluid at this point flows slower. The belt is shaped in a corresponding way.

The pressing zone between the loading shoe of the variable crown roll and the roll jacket can also be controlled by means of a MR/ER fluid.

Another object of the invention is heat transfer, that of paper and/or board machines and their finishing equipment in particular, wherein MR/ER fluid is used as a flowing heating medium, the flow and heat transfer properties of which can be manipulated. In this way, the heat transfer can be controlled and thus the operation of the regulating unit or the process, for example, can be influenced. In particular, the objects of application can include rolls, such as the heated rolls of a pressure apparatus, the thermo rolls of a calender, and the cooled polymer rolls of the calender.

Heat transfer between a flowing medium and a fixed surface primarily depends on the flow of the boundary layer, its velocity profile in particular. The velocity profile instead depends on the viscosity of the flowing agent. The boundary layer of low-viscosity agents is thinner and the velocity gradient higher, whereby heat transfer through the layer is more effective. According to the invention, the heating-cooling event can be controlled in a new way. The flow in the heat transfer pipe can also be decelerated by means of a "valve" based on the MR/ER effect, whereby a change in the flow velocity as such has an effect on the heat transfer.

According to the invention, heat transfer can be controlled, for example, through a pipe so that the viscosity of the fluid is increased on one part of the pipe wall, whereby the heat transfer through this part is decelerated. In this way, the temperature distribution of the roll and thus also the shape of the surface, will be as even as possible.

Uses of the heat transfer application in paper and/or board machines and their finishing equipment include:

Heating the thermo rolls of the calender

Balancing the heat of and cooling the polymer rolls of the calender

Rolls of pressure apparatus

Valve operations.

MR fluid in particular can be used as a heating medium in a heating system. In that case, electromagnets can be added to periphery bores in the roll, for example, to control the flow. The magnets can be placed in a special inner tube, for example, or the inner surface of the bore can be coated with a permanent or an electro magnet. The magnets can be, for example, tubular, and placed on the channel wall either regularly or on part of the wall only. The magnet in the tube as such also works as a displacement piece. The magnet actuators can be distributed, for example, at functional blocks in the cross machine direction so that they can also be used for profiling. They can be used in particular to control the development of the flow in the cross machine direction, whereby the so-called choking piece is not needed. The magnets can also be placed in a position, where the transfer of heat to the roll jacket is easier in a tangential direction. In that case, the so-called ginger biscuit problem decreases, when the heat distribution of the jacket becomes more even.

MR/ER fluid can also be used for heat transfer in connection with the so-called centre-drilled thermo roll. For example, a magnet placed in the middle of the bore in the axial direction of the roll works as a sort of a displacement piece, because the flow in its vicinity in the magnetic field decelerates and the flow tends to circulate the area in question. Accordingly, a traditional displacement piece is not needed.

The method can be applied to polymer rolls in a similar manner as to the thermo rolls. The displacement piece in the centre bore in particular can be replaced. The control of heat balancing or cooling in the cross machine direction at segments (profiling) is also possible.

MR/ER fluid can also work as a valve in heat exchangers to decelerate or stop the flow. Its function is stepless and accurately adjustable, and no moving parts are included. The valve is insensitive to impurities, and no malfunction of mechanical valves occurs. The flow resistance of a narrow channel grows in a sufficiently strong field, and the flow stops. The valve function can be used, for example, in heat transfer tube systems, the bypass manifolds of heat distribution lines and, when the flow is directed (e.g., to the bores of thermo rolls).

Magnets/electrodes can also be located in the end piece of a centre- or periphery-drilled thermo roll or polymer roll, and the flows in the set of flow channels can be controlled. It is especially advantageous to place the magnets/electrodes in the end piece already at the manufacturing stage.

By means of the magnets/electrodes located in the end piece of the roll, the "valve function", for example, can be applied, whereby some of the channels leading to the periphery borings are closed or choked, or the direction of flow is changed. It is especially advantageous to select the periphery bores or the flow direction used according to the kind of heating/cooling that is needed in the respective situation. When great heat transfer power is needed, e.g., at the heating/cooling stage, the most advantageous method for this particular situation is used. In an actual process situation, when the roll temperature should be as steady as possible, some other, more preferable method for this situation can be used.

The valve solution based on the MR/ER technique can be used, for example, in the arrangement disclosed in the publication FI-B-105115, wherein the flow channels of the medium are placed on several radial planes. When so desired, some channels can be closed using MR/ER valves. The MR/ER valves can be used to implement a valve means or a bypass manifold, which is located in the end flange of the roll, for example, and which can be used to combine or separate the flow channels. In that case, in a running situation for example, a channel geometry can be used, which carries out the heating as evenly as possible (the so-called ginger biscuit effect and any differences in the temperatures in the axial direction of the rolls are minimized), and at the heating and cooling stages, a channel geometry can be used, which heats/cools as effectively as possible.

The thermal resistance of the MR fluids commercially available at the moment is about −40 . . . +150° C. The resistance properties are determined on the basis of the basic phase (mineral oil or the like). The thermal resistance can be improved, for example, by using special heat transfer oils as the basic phase.

A third object of the invention is the control of operation of the movement regulating units in paper and/or board machines and their finishing equipment, such as dampers, linear dampers in particular, switches and brakes. The movement of the regulating units can be linear or rotary. According to the invention, the adaptive flowing properties of the MR/ER fluids are utilized, viscosity in particular, which can be used to dampen the movement or transmit power.

A fluid damper, a vibration damper in particular, can be constructed from MR or ER fluids. The applications include dampening the vibration of the static structures and the rotary mechanical parts, among others, in the head box, the machine wire and pressure apparatus section, the calender, the surface sizing and coating machines, and the reelers. Dampening the vibration of the axle bearing support of the roll can be mentioned as an example. The regulating unit can be connected to a hydraulic cylinder, for example. Generally, the purpose can be considered to be to control/manipulate the rigidity of the structure to eliminate harmful vibration, for example, by altering the rigidity of the structure (i.e., that of interconnected mechanical parts), the specific frequency of the structure in question is influenced.

The MR/ER damper according to the invention is, in principle, semi-active as it does not produce the movement itself, but its dampening properties can be adjusted in real time. One advantage of the MR/ER damper over the traditional hydraulic damper is, primarily, the possibility to control the damper in an optimal way in accordance with the loading situation. This can be useful, for example, when the oscillation frequency changes in accordance with the rotational speed. Also, when the oscillating mass grows, e.g., in a reeling drum roller, it can be advantageous to exploit the adaptive properties of the damper. The semi-active damper is also safe, because it turns into a passive damper, if the control signal breaks off. The movement control according to the invention is quick and accurate.

The solution according to the invention for controlling a movement can be applied in controlling, for example, the vibration of the rotary parts in head boxes, the machine wire and pressure apparatus section, the calender, the surface sizing and the coating machines, and the reelers.

Applications of the damper include:

Dampening the vibration, whereby it can be used to replace part of the active dampening. Applications can include calender rolls, reeling drum rollers, coating stations (including the coating blade), and the framework Stopping the movement, such as receiving masses and the controlled stopping of the movements of various actuator levers Controlling the movements and the dampening of the dancer roll Emergency opening.

One applicational scope is to stop the movement of large masses by means of a semi-active damper. Examples include stopping the movement of a reeling drum roller and the emergency opening of a set of calender rolls. A general object is a soft and flexible stopping of the movement in order to avoid sudden large loading of the structure.

Applications of the control of the rotary movement include the torque adjustment of the centring reeler combined with a single speed motor, decelerating a reeling drum roller, decelerating the rotary movement of rolls in an emergency situation, for example. Furthermore, an overload circuit breaker can be constructed for the rotary transmission lines. On the basis of its control, the MR/ER switch transmits a known torque, whereby by measuring the slip of the switch, the state of overload can be determined. When connected to a computer, the switch can be immediately opened, whereby larger damage is avoided. The switch is also immediately activated, when the voltage is reconnected. Examples include the use of pulper mixers, wherein overload situations often occur, when pulpering rejected rollers, for example.

MR/ER fluid can be used in a so-called viscous coupling, whereby it can be used to replace both traditional mechanical switches and viscous couplings. The viscous couplings contain no wearing switch chairs. The coupling process in the MR/ER viscous coupling is controlled. The switch can slip, when needed, and the torque to be transmitted is easy, quick, and accurate to transfer.

Applications of the switches and the brakes include:

Jointly with a single speed electric motor, whereby it can replace a hydraulic motor Auxiliary rotation of a set of rolls Decelerating the rotary movement, such as stopping the rotary movement of the rolls and decelerating a reeling drum roller, whereby the braling action is controlled.

A fourth object of the invention consists of the control valves of the delivery pipe systems of the lubricant of a shoe roll or profile-controlled roll, of heat transfer pipe systems, and of bypass manifolds and the emergency opening cylinders of a set of calender rolls in paper and/or board machines and their finishing equipment.

A fifth object of the invention consists of the sealing solutions of paper and/or board machines and their finishing equipment. The MR/ER fluid can also be used as a self-sealing material. When a field is focused on the junction or the seam of a structure containing fluid, the fluid can be made to congeal locally, and cannot flow out of the gap or the seam. In principle, the applications include all static joints. Such sealing can be used, for example, in the delivery pipe systems of the heating medium (oil) of a thermo roll, in the joints of rotating rolls, and in sealing the hydraulic system of a shoe nip.

In the following, examples of some embodiments of the invention are shown. The appended drawings are part of the description.

DESCRIPTION OF THE PREFERRED EMBODIMENT

Figure 1:
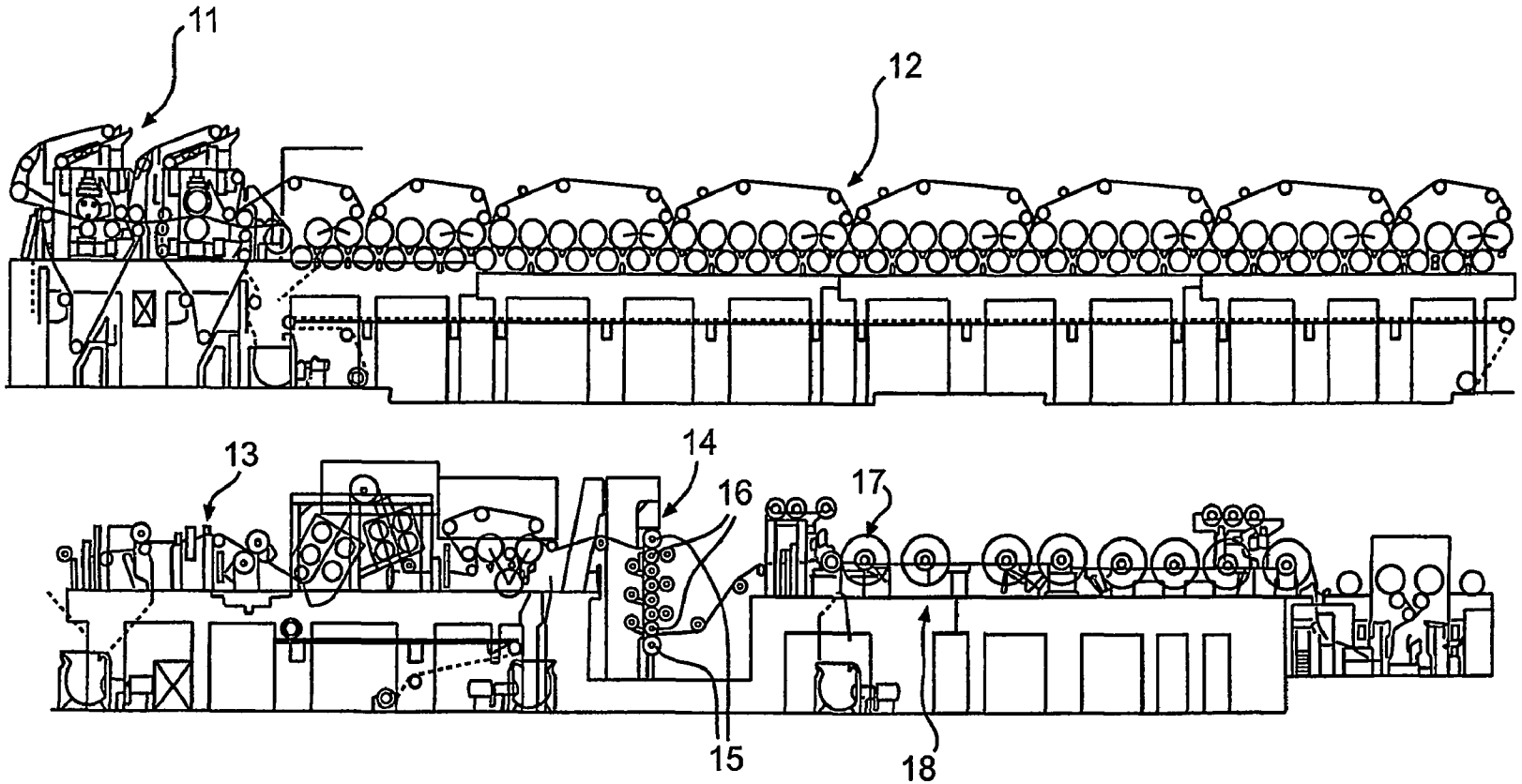
FIG. 1 shows the whole paper machine with its finishing stages.

FIG. 1 shows a paper machine including the following applications of the invention, among others: a pressure apparatus section 11 (adjustment and control of the pressure apparatus), the adjustment and control of the regulating units of a drying section 12 and a coating section 13, the variable crown rolls 15 and the thermo rolls 16 of a calender 14, reelers 17, and regulating units 18.

Figure 2:
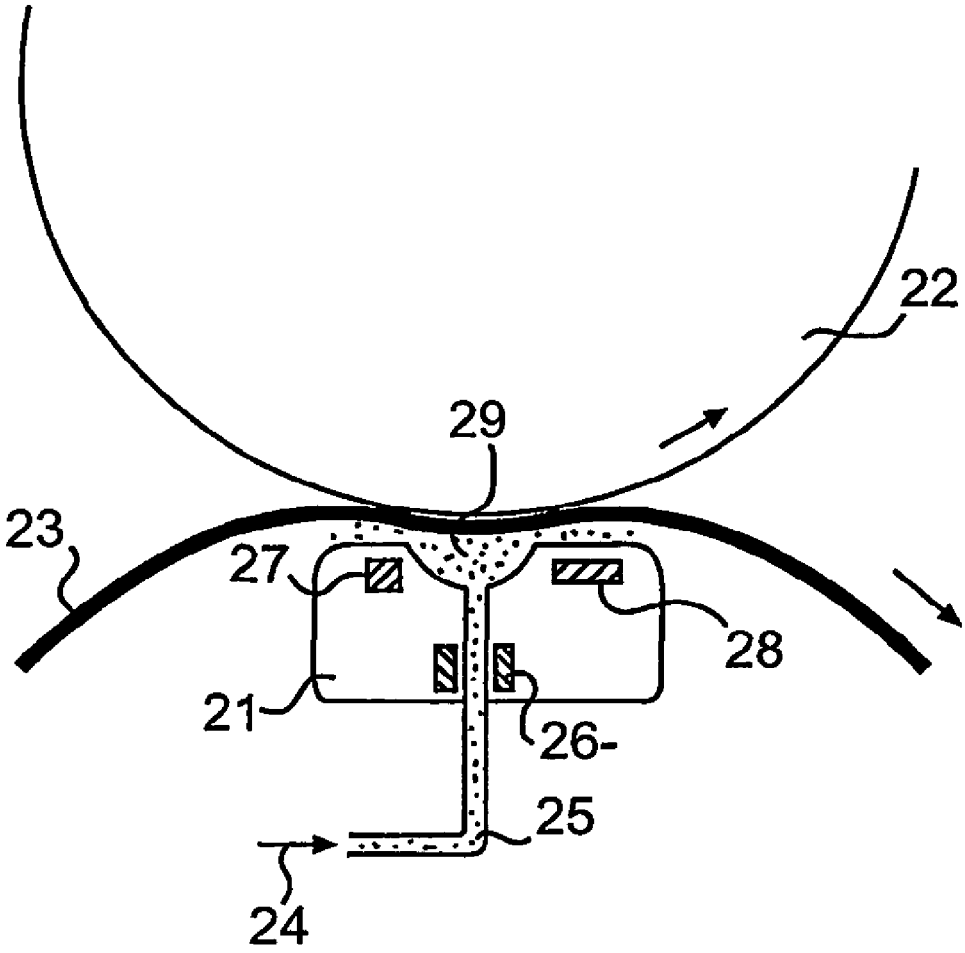
FIG. 2 shows an application of the invention in a long nip.

FIG. 2 shows a long nip. The shoe 21 of the nip according to the figure is located below a thermo roll 22. A sym-belt roll with a belt 23, for example, works as the backing roll of the thermo roll. The shoe 21 acts as a mechanical supporting structure. MR fluid (oil) 24 is pumped between the shoe and the belt, forming a lubricating layer and transmitting hydraulic pressure to the nip. The adjustment of the fluid pressure is implemented by means of the flow control by connecting electromagnetic flow velocity controllers 26 to an oil delivery pipe system 25. By means of the flow velocity controllers, the viscosity of the fluid can be adjusted steplessly, and thus the hydrostatic pressure exerted on the belt can be adjusted.

For the hydro-mechanical adjustment of the coating flow, a front magnet 27 and a rear magnet 28 are connected to the shoe 21 of the long nip, affecting the fluid coating. The magnets are electromagnets. The front magnet affects the fluid 24 in the fluid pocket 29 of the shoe, and the rear magnet 28 affects the fluid properties in the fluid coating 29 of the rear of the shoe.

The adjustments of the magnets 27 and 28 can be used to change the viscosity of the fluid 24 and, through that, the hydrodynamic operation of the nip can be influenced. The viscosity of the fluid can be changed locally in a few milliseconds.

Magnets 27 and 28 can be located in different points of the shoe 21, longitudinally distributed, whereby compression of the nip 10 in the machine direction (MD) can be accurately adjusted. Several separate magnets can also be connected to the shoe in the cross machine direction (CD), distributed in sections, for example, whereby the viscosity of the fluid 24 can be profiled in the cross machine direction, and the pressure distribution and the shape of the nip can thus be accurately adjusted in different points. The belt 23 takes a shape similar to the shape of the shoe and transmits adjustments in the machine direction and the cross machine direction to the thermo roll 22. The number, the location, and the power of the magnets are always selected according to the required adjustment, the materials driven on the nip, the adjustment ranges needed, etc.

In fault situations of the magnets 27 and 28, the nip works as a normal mechanical long nip. In fault situations of the flow velocity controllers 26 of the delivery pipe system 25 of fluid 24, the feeding of the fluid can be adjusted by means of the pumping pressure.

Figure 3:
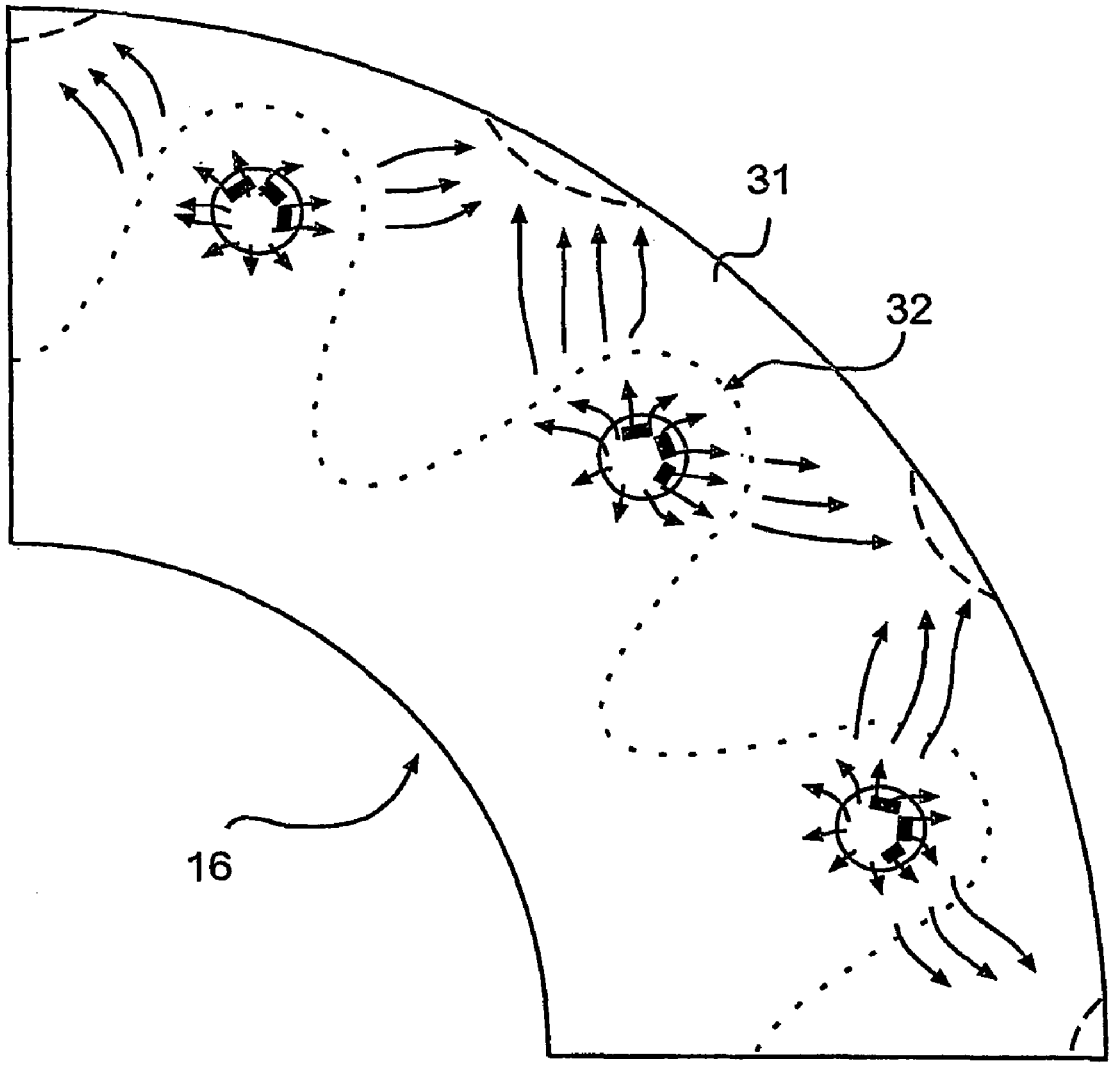
FIG. 3 shows the heat transfer of a thermo roll.

FIG. 3 shows a thermo roll 16. In the jacket of the roll, near the outer surface, axial heating channels 31 are provided, through which MR fluid is conducted as a heating medium. Electromagnets 32 are connected to the channels on the side of the outer surface of the roll jacket. The viscosity of the medium is increased by means of the magnets and, at the same time, the flow velocity is decreased in the part of the channel on the side of the magnets. In this way, heat transfer through the wall on this side of the channel is also decelerated, and more heat is transferred to the outer surface of the jacket in the areas between the channels. Accordingly, the intention is rather to direct the flow of heat in the tangential direction (like an ellipse). In this way, the temperature of the surface and thus also its shape, will be as even as possible.

The adjustment is extremely accurate and it can be implemented as quickly as in a few milliseconds along a distance of a few millimetres.

Magnets 32 can be used in different points in the cross machine direction of the roll 16 in sections and, in this way, the profiling of the heating and cooling power can be locally influenced in different points of the thermo roll.

The invention claimed is:

1. A method for controlling the operation of a paper, board or tissue production line comprising the steps of:

using a fluid selected from the group consisting of: a magneto-rheological fluid and an electro-rheological fluid; as a lubricant in a gap formed between surfaces in a production line comprising a fixed surface and a surface that is moved over the fixed surface; and controlling the flow characteristics of said fluid in said gap with a magnetic or electrical field between the fixed surface and the surface that is moved over the fixed surface, to vary the fluid's viscosity in said gap, and so control lubrication, wherein the fluid is used as a lubricant between a shoe of a long nip forming the fixed surface and a rotating belt forming the surface that is moved.

2. The method of claim 1 wherein controlling the flow characteristics of said fluid with a magnetic or electrical field also varies a hydraulic length of the shoe.

3. The method of claim 2 wherein varying the hydraulic length of the shoe in a cross machine direction is used to profile a web.

4. The method of claim 1 further comprising the step of varying the hydraulic shape of the shoe by focusing a magnetic or electric field of a selected size at selected points on the shoe.

5. A method for controlling vibration in a paper, board or tissue production line, comprising the steps of:

manipulating the rigidity of a structure forming part of the production line so as to reduce vibration using a fluid selected from the group consisting of: a magneto-rheological fluid and an electro-rheological fluid by placing the fluid between two interconnected mechanical parts of the structure and controlling the damping characteristics of the magneto-rheological or electro-rheological fluid with a magnetic or electrical field between the two parts to vary the fluid's viscosity, and to change the specific frequency of the structure an effective amount to eliminate harmful vibration.

6. The method of claim 5 wherein the production line includes a roll supported by an axle bearing support, and the roll and axle form the two interconnected mechanical parts and the step of manipulating the rigidity of a structure includes the step of controlling the axle bearing support's rigidity in real time to dampen vibration in the roll.

7. The method of claim 5 wherein a rotating mass forms one of the two interconnected mechanical parts and the step of manipulating the rigidity of the structure is performed in response to a change in rotation speed or mass of the rotating mass. characteristics are changed in a controlled way, is used as the fluid.

8. A method for controlling the operation of a paper, board, or tissue production line, comprising the steps of:

using a fluid selected from the group consisting of: a magneto-rheological fluid and an electro-rheological fluid as a heating or cooling medium, in a device forming part of the production line; and profiling with the heating or cooling medium within the device with a magnetic or electrical field applied to the fluid.

9. The method of claim 8, wherein the fluid is used as a heating medium of a roll of a pressure apparatus or of a roll of a calender within the production line.

10. The method of claim 8 wherein the fluid is used as a heating medium of a center or periphery-drilled roll.

11. The method of claim 8 further comprising the step of controlling the flow characteristics of the fluid in axially extending heat transfer channels in a roll, and further comprising the step of: controlling fluid viscosity to control the thickness of a boundary layer of portions of the heat transfer channels with the magnetic or electrical field to decrease heat flow through said portions.

12. The method of claim 8 wherein the roll defines a jacket having an outer surface and portions of the axially extending heat transfer channels closest to the outer surface are controlled with the magnetic or electrical field to increase fluid viscosity along said portions closest to the outer surface to decrease heat transfer along said portions closest to the outer surface so that more heat is transferred to the jacket surface in areas defined between the channels.

* * * * *